United States Patent [19]

Gordy

[11] Patent Number: 4,548,675

[45] Date of Patent: Oct. 22, 1985

[54] NONSULFUR CHEMIMECHANICAL PULPING PROCESS

[75] Inventor: John Gordy, Richmond, Canada

[73] Assignee: New Fibers International, Nassau, The Bahamas

[21] Appl. No.: 554,909

[22] Filed: Nov. 25, 1983

Related U.S. Application Data

[63] Continuation-in-part of Ser. No. 494,703, May 16, 1983, abandoned, which is a continuation-in-part of Ser. No. 303,944, Sep. 21, 1981, Pat. No. 4,397,712, which is a continuation-in-part of Ser. No. 237,723, Feb. 24, 1981, abandoned, which is a continuation of Ser. No. 83,784, Oct. 11, 1979, Pat. No. 4,259,147, which is a continuation of Ser. No. 842,262, Oct. 4, 1977, abandoned, which is a continuation of Ser. No. 551,259, Feb. 20, 1975, abandoned.

[51] Int. Cl.[4] ..... D21C 3/02; D21C 3/20

[52] U.S. Cl. ..... 162/26; 162/72; 162/90

[58] Field of Search ..... 162/72, 90, 26

[56] References Cited

U.S. PATENT DOCUMENTS

| | | | |
|---|---|---|---|
| 2,192,202 | 3/1940 | Peterson | 162/72 |
| 4,259,147 | 3/1981 | Gordy | 162/70 |
| 4,397,712 | 8/1983 | Gordy | 162/72 |

OTHER PUBLICATIONS

Tappi Sep. 3, 1972 pp. 107–114.

*Primary Examiner*—William F. Smith

*Attorney, Agent, or Firm*—LeBlanc, Nolan, Shur & Nies

[57] ABSTRACT

A nonsulfur chemimechanical pulping process for producing pulp from woody materials is disclosed. The process is particularly suited for producing corrugating medium pulp from hardwood chips although the process can be adapted to production of other types of pulp and can use other types of woody materials. The process comprises impregnation and dilution of the chips in a dilute aqueous pulping solution of a lower alkanolamine catalyzed with ammonium hydroxide. The preferred alkanolamine is monoethanolamine present in a weight ratio to ammonium hydroxide of about 1 part to 1 part or less to 1 part to 3 parts or more. The pulping solution may be repeatedly reused and the process of this invention does not produce environmentally objectionable by-products.

17 Claims, No Drawings

NONSULFUR CHEMIMECHANICAL PULPING PROCESS

This application is a continuation-in-part of application Ser. No. 494,703, filed May 16, 1983, abandoned, which application was a continuation-in-part of application Ser. No. 303,944, filed Sept. 21, 1981, now U.S. Pat. No. 4,397,712, which application was a continuation-in-part of patent application Ser. No. 237,723, filed Feb. 24, 1981 abandoned, which was a continuation of U.S. patent application Ser. No. 083,784, filed Oct. 11, 1979, now U.S. Pat. No. 4,259,147, which was a continuation of U.S. patent application Ser. No. 842,262, filed Oct. 4, 1977, now abandoned, which in turn was a continuation of Ser. No. 551,259, filed Feb. 20, 1975, now abandoned. This application is also related to U.S. patent application Ser. No. 083,785, filed Oct. 11, 1979, now U.S. Pat No. 4,259,151, which was a continuation of U.S. patent application Ser. No. 962,971, filed Nov. 22, 1978, now abandoned, which in turn was a continuation-in-part of U.S. patent application Ser. No. 959,620, filed Nov. 13, 1978, now abandoned, which in turn was a continuation of U.S. patent application Ser. No. 821,468, filed Aug. 3, 1977, now abandoned, which in turn was a division of U.S. patent application Ser. No. 551,259, filed Feb. 20, 1975. Accordingly, the disclosures of said parent U.S. patents and patent applications are hereby incorporated by reference in their entirety.

This invention relates to a nonsulfur chemimechanical pulping process (NSCMP) for producing pulp from woody materials. The process of this invention involves the discovery that a wide variety of woody constituents can be pulped in a dilute aqueous solution of a lower alkanolamine catalyzed by ammonia to produce a superior pulp in very high yields.

This invention also relates to an improved wood pulping process for removing lignin constituents thereof without contamination so that the pulping solution can be repeatedly reused, the pulping chemicals distilled therefrom, and the residue used as a fuel. The residue may be burned in conventional equipment and does not produce noxious or poisonous gaseous by-products normally associated with the by-products of conventional pulping operations.

In the above-identified parent patent applications, processes and an apparatus for producing different grades of wood pulp from a variety of wood species were disclosed. The processes produced, in high yields, pulps from dissolving grade to container grade, or an intermediate fibrous material and readily reusable by-products. Most importantly, however, the parent processes pulped wood without the use of toxic liquors or noxious gases generally associated with conventional pulp processes. The lignin constituents were removed from the pulp as uncontaminated by-products suitable for commercial utilization.

It was also disclosed that a lignin dissolving mild organic base could be used to produce a corrugating medium pulp of superior quality and that such base could be reused as a pulping solution subsequently. Specifically, a lignin dissolving, mild organic base such as monoethanol amine, in vapor phase cooking, was found to be capable of initiating a lignin depolymerization reaction in wood chips whereby the lignin constituents could be extracted. The chips could then be refined and used to produce corrugating medium pulp. The resulting by-product solution when diluted could be reused many times as a pulping medium.

It has now been discovered that in a batch, a batch continuous, or a continuous process, a pulping solution consisting of a dilute aqueous solution of the lignin dissolving solvent, a lower alkanolamine catalyzed with ammonium hydroxide will produce superior results. Ammonium hydroxide may, in a batch or batch continuous process, be present as a major ingredient in the pulping solution, and in one preferred embodiment ammonium hydroxide is present in a weight ratio of about 3:1 to the lower alkanolamine.

In continuous application, whereas the preferred weight ratio of the lignin dissolving solvent to the woody materials remains unchanged, and the liquid to chips ratio also remains essentially unchanged, optimum results are achieved with a lower concentration of ammonium hydroxide. Although the ratio of 3:1, ammonium hydroxide to amine, preferred in batch and batch continuous operation, will produce acceptable strength results in continuous operation, optimum results in continuous operation have been found to be produced by a weight ratio of ammonium hydroxide to amine of about 1:1, or less.

The alkanolamine, monoethanolamine, has been disclosed as the pulping agent in U.S. Pat. No. 2,192,202 to Peterson et al. In that patent, however, the process disclosed required an unusually long cooking time of from 4 to 20 hours in a cooking liquid containing 70–100% of the alkanolamine. Clearly such a long cooking time is not commercially desirable, and the quantities of chemicals involved also rendered the process quite expensive. Recently the use of certain alcohols and amines as additive in alkaline pulping was also described. See "Alkaline Pulping in Aqueous Alcohols and Amines" by Green et al, TAPPI, Vol. 65, No. 5, p. 133 (May 1982). In that article, tests of monoethanolamine, ethylene diamine, and methanol as solvent systems in soda (sodium hydroxide) pulping were described. The article, however, concluded that the pulps produced at low amine charges did not possess sufficient burst and tensile strengths. At high amine levels a lower alkali content was required, but this resulted in a deterioration of cellulose viscosity and pulp mechanical properties.

It has been discovered, however, that a lower alkanolamine such as monoethanolamine in dilute aqueous solution with ammonium hydroxide will pulp a wide variety of different wood species in extremely high yields of 85–95% and will produce a superior hardwood pulp suitable for corrugating medium. The process also may be adapted to produce other pulps as will be obvious to those skilled in the art. Pulping time required is normally about 15 minutes, but may extend up to 1 hour depending upon the wood species and pulp produced.

Accordingly, it is an object of this invention to produce a nonsulfur chemimechanical pulping process which will rapidly and efficiently pulp a wide variety of different wood species.

It is another object of this invention to provide a nonsulfur process for producing a superior grade of corrugating medium pulp from hardwoods.

It is yet another object of this invention to provide a pulping solution consisting of an alkanolamine and ammonium hydroxide in dilute aqueous solution which may be repeatedly reused to pulp green wood chips without noxious or harsh chemical by-products.

It is still another object of this invention to provide a continuous wood pulping process for producing superior grades of corrugating media from hardwoods such as aspen, alder and the like in a reusable pulping solution of a lower alkanolamine, ammonium hydroxide, and water which when spent may be efficiently and easily distilled to salvage chemical constituents thereof producing a concentrated lignin containing solution suitable for disposal as, for example, a fuel, without problems normally associated with by-products from commercial pulping processes.

These and other objects of this invention will become readily apparent with reference to the following description:

One of the important features of this invention is the discovery that a pulping media consisting of a lower alkanolamine catalyzed by ammonium hydroxide will produce a superior grade pulp in unexpectedly high yields from virtually any type of woody material. While the preferred embodiment of this invention utilizes monoethanolamine, diethanolamine, triethanolamine, and monoisopropanolamine, as well as other lower alkanolamines, are intended within the scope of this invention as lignin dipolymerizing agents.

Furthermore, high concentrations of said depolymerizing agents are not needed for effective pulping when the pulping media is an aqueous solution thereof catalyzed by the presence of ammonium hydroxide. In the preferred embodiment of this invention, corrugating media pulp can be produced from preferably any type of hardwood in a pulping solution which can be repeatedly reused until the lower alkanolamine is virtually completely reacted. The spent pulping solution then may be concentrated by distillation to remove the chemical constituents for reuse, if desired, leaving a lignin-containing residue which has a very high fuel value and virtually none of the pollution problems associated with the residues from standard pulping processes. In fact, the lignin-containing residue may be used as, for example, a boiler fuel, in conventional equipment because it produces none of the noxious gaseous by-products associated with the burning of residues from conventional pulping processes.

The process of this invention may utilize an initial impregnation step with pulping solution followed by a vapor phase digestion step under a vapor dome. Preferably, however, the pulping solution may be used in a combined impregnation and digestion step optionally preceded or followed by a steam treatment step. The treatment time, as will be subsequently described, will vary with the wood species used and the type of pulp produced. However, corrugating media pulp of superior quality has been produced in very high yields with a digestion-impregnation time of about 15 minutes.

The process of this invention is suitable for batch digestion equipment, batch continuous digestion in multiple digesters, or continuous pulping in conventional equipment. However, it is preferred to utilize the digestion equipment as described in, for example, my U.S. Pat. No. 4,259,151, and given commercial requirements multiple of such digesters in a batch continuous process. It will be obvious to those skilled in the art, however, that the type of digestion equipment is not intended to be limitative of the scope of this invention.

As an example of a preferred embodiment of this invention, used to produce corrugating medium pulp, fresh, green hardwood chips of woods such as alder, aspen, oak, and the like are used. The pulping solution is prepared as a dilute aqueous solution of a lignin dissolving solvent, such as a lower alkanolamine, and ammonium hydroxide.

Monoethanolamine, the preferred solvent, is mixed with ammonium hydroxide in proportions of about 10–12 gal. of monoethanolamine having a concentration of 8 lbs. per gal. to 36–40 gal. of ammonium hydroxide. The weight ratio then is about 100 lbs. of monethanolamine to about 300 lbs. of commercial grade ammonium hydroxide. The mixture is then diluted with about 1,000 gal. of water. Accordingly, about 50 gal. of the mixture is diluted with about 1,000 gal. of water. Then about 600 gal. of the dilute mixture is combined with 2,000 lbs. of green hardwood chips in a digester.

Typically in utilizing the preferred digester superior grade of corrugating medium pulp is produced in yields of up to about 95% by digesting the chips under a pressure of about 50 psi and a temperature of about 285° F. for about 15 minutes. As will be subsequently explained the digestion procedure may vary as required. Typically, however, the chips are initially impregnated for a few minutes as the digester is heated to remove entrained air. Subsequently the liquid level in the digester is dropped below the chip mass and the chips are digested under the above conditions in vapor phase.

Following digestion, the digester vessel is typically vented to a heat exchanger to recover the heat value of the digester gases and the liquid from the digester is routed to a blow tank containing an equal volume, i.e. 600 gal., of dilution water. The chips are then washed in another volume, i.e. 600 gal., of water and the wash water and dilute pulping solution are combined. The pulping solution is ultimately returend to storage tanks for reuse. The above quantities are sufficient for at least about four digestion procedures with hardwood chips.

The pulping solution is recovered for reuse by preferably distillation. Condensate recovery returns the cooking chemicals back to the process, lowering chemical costs and process water requirements. The thick liquor residue resulting from distillation has been found to have a high BTU value, up to 10,000 BTU per oven dry pound. This residue is easily burned in a standard boiler utilizing either oil or wood and has been found to have a very low inorganic content. It therefore produces only small quantities of ash and no substantial chemical residues such as found in conventional kraft process residues and the residues of other commercial processes including the neutral sulfite process.

After separation of the pulp from the pulping solution, the pulp is subjected to standard screening and pulp washing processes to form a low consistency pulp solution. The low consistency pulp is then pumped to, for example, a continuous pulp presser to separate water and increase the consistency of the pulp to a desired consistency number. Typically pulp consistency of 12–40% is obtained.

The high consistency pulp is then refined. Refining is used to reduce the Shive content of the pulp and to develop the desired paper properties. It is necessary in the production of corrugating medium pulps, and other pulps, that the pulp have a good tensile and wet web strength so that the wet pulp sheet will have sufficient strength to prevent tearing and consequent shutdown of the paper machine. Refining also serves to separate individual fibers more fully, make the fibers more flexible, and to give the fibers a "fibrillated" surface in order to enlarge the contact area between the fibers in the final paper and to increase pulp strength.

The process of this invention produces corrugating medium pulps having desired properties such as high tensile strength, high wet web strength, high concora numbers, and similar requirements. Corrugating medium pulps produced by other processes do not yield the necessary tensile and web web strength properties. It is therefore necessary with other processes to add expensive chemical pulps to the corrugating medium pulp to develop these properties. By eliminating the requirement for expensive chemical pulp additives the process of this invention then substantially decreased production costs.

After high consistency refining, the corrugating medium pulp is pumped to a second pulp press, and the pulp is de-watered to an oven dry content of about 30%. The pump at this point is sufficiently dry to handle as a solid and is in the form of nodular pulp (pulp flakes). The flakes may be stored in fiber drums or other suitable containers depending upon market conditions, and stored in a warehouse.

In another embodiment of the process of this invention utilizing two digester vessels such as those described in my U.S. Pat. No. 4,259,151, batch continuous operation is possible.

Initially, 2,000–3,000 lbs. of green chips, for example 50% oak–50% aspen, are loaded into the first digester with 600 gal. of the pulping solution of this invention. The digester is then heated to about 212° F. with steam, leaving the overflow vents open to remove entrained air.

While the first digester is heating, the second digester is evacuated. The second digester is also cooled, as, for example, by circulating cooling water through the heating jacket or coils. This procedure allows the venting of digester No. 1 into digester No. 2 in a very short period of time.

After digester No. 1 reaches 212° F., the vents are closed and the digester heated to 75–100 psi for a period of about 15–30 minutes to cook the chips. In the preferred process, the cooking occurs in vapor phase under a vapor dome of the cooking solution. However, within the scope of this invention, the chips may be initially impregnated with the cooking solution, and cooked in a steam atmosphere. In an alternative, this invention is intended to comprehend a continuous digestion process with, for example, a screw type conventional digester for continuous digestion in liquid phase. In each of these embodiments, however, the cooking solution utilizing dilute amine lignin dissolving solvent with an ammonia catalyst has been found to produce unexpectedly high yields in very short cooking times. While corrugating medium pulp is of primary interest herein, it must also be recognized that other types of pulps may be produced, and that the process of this invention is equally suitable for pulping hardwood chips, softwood chips, and mixed hardwood and softwood chips.

At the end of the initial cook, digester No. 1 is vented into digester No. 2. Venting time as noted above is decreased by evacuation and cooling of digester No. 2 and should occur in about 10–15 minutes. When the pressure in digester No. 1 reaches about 10 psi, the spent cooking solution and cooked chips are blown into a blow tank. During the blow down of digester No. 1, digester No. 2 is filled with green chips and cooking solution and cooked as described above relative to digester No. 1. Digester No. 1, after blow down, is evacuated and cooled in preparation for venting from digester No. 2.

The use of two digester vessels results in an efficient batch-continuous operation utilizing heat in the digesters. Cooling water is returned to wash water storage tanks.

After blow down, the chips and pulping solution are agitated in the blow tank with mixers to provide initial defibrating and easier pulping of the partially defibered chips. After the initial defibrating step, the defibrated chips and pulping solution are pumped to a first refiner. The first refiner serves as a further defibrator to ensure complete defibration of the cooked chips. The defibered pulp and the pulping solution are then pumped to a series of screens where the defibered pulp is separated from the pulping solution. The pulping solution is pumped to storage and processed in a spent liquor evaporator to recover condensate. The condensate is then utilized in the preparation of new cooking solution.

After separation of the pulping solution the pulp is washed and is in the form of low consistency pulp solution. The low consistency pulp solution is then dewatered to produce high consistency pulp which is then subjected to a refining step.

The following tables illustrate test data from different cooking times. The chips cooked were 100% aspen or 50% aspen, 50% oak. The yields, as shown, generally were between 85 and 95%. Most importantly, the necessary pulp characteristics for a high grade corrugating media pulp were produced.

TABLE 1

100% ASPEN

Sample LDC-0803 - 100% Aspen
Cooking Time = 15 minutes
Cooking Sol. - 1 part MEA. 3 $NH_4OH$
Cooking Yield = 93.11%

| BEATING TIME, MINUTES | 30 | 40 | 47 | 65 |
|---|---|---|---|---|
| Freeness C.S., cc | 489 | 382 | 290 | 101 |
| O.D. Sheet Wt. | 2.62 | 2.67 | 2.54 | 2.62 |
| grams/meter (sq) | 131.11 | 133.54 | 126.97 | 131.12 |
| Caliper Avg. SS, mm | .357 | .331 | .267 | .251 |
| Std. dev. | .012 | .004 | .008 | .003 |
| Apparent Density g/cc | .367 | .403 | .476 | .522 |
| Bulk, cc/g | 2.72 | 2.48 | 2.10 | 1.92 |
| Burst Average, Kpa | 145.45 | 189.13 | 230.68 | 312.67 |
| Std. dev. | 6.28 | 8.93 | 25.11 | 22.73 |
| Burst Index mN m(sq)/g | 1.11 | 1.42 | 1.82 | 2.38 |
| Tensile Avg. kg/m | 231.98 | 320.77 | 350.63 | 557.94 |
| Std. dev. | 30.42 | 29.36 | 21.78 | 95.90. |
| Breaking Length, Km | 1.77 | 2.40 | 2.76 | 4.26 |
| Tensile Index, kN*m/kg | 17.35 | 23.56 | 27.08 | 41.73 |
| Stretch Avg., % | 0.80 | 0.84 | 0.96 | 1.14 |
| Std. dev. | 0.00 | 0.94 | 0.05 | 1.25 |
| Tear Avg., 16 ply mN | 602.73 | 646.68 | 612.14 | 502.27 |
| Std. dev. | 26.26 | 105.53 | 139.51 | 105.68 |
| Tear Index mH m(sq)/g | 4.60 | 4.84 | 4.82 | 3.83 |
| Double Folds Avg., 1.0 kg | NA | NA | NA | NA |
| Std. dev. | NA | NA | NA | NA |
| Gurley Air Resistance sec/100 cc 20 oz. cyl. | 9.2 | 23.53 | 53.47 | 409.70 |
| Brightness, Elrepho | 26.47 | 27.50 | 27.00 | 25.87 |
| Concora Med. Test, N | 159.39 | 243.16 | 286.15 | 143.61 |
| Std. dev. | 29.56 | 14.53 | 4.27 | 1.38 |
| Ring Crush, kN/m | 1.21 | 1.66 | 1.71 | 1.80 |
| Std. dev. | 0.04 | 0.07 | 0.10 | 0.11 |

TABLE 2

100% Aspen

LDC-0804 - 100% aspen
Cooking Time = 30 minutes
Cooking Sol. - 1 part MEA. 3 parts $NH_4OH$
Cooking Yield = 93.42%

| BEATING TIME, MINUTES | 40 | 48 | 57 | 80 |
|---|---|---|---|---|
| Freeness C.S., cc | 495 | 412 | 312 | 112 |
| O.D. Sheet Wt. | 2.06 | 2.05 | 2.07 | 2.06 |

TABLE 2-continued

100% Aspen

LDC-0804 - 100% aspen
Cooking Time = 30 minutes
Cooking Sol. - 1 part MEA, 3 parts $NH_4OH$
Cooking Yield = 93.42%

| BEATING TIME, MINUTES | 40 | 48 | 57 | 80 |
|---|---|---|---|---|
| grams/meter (sq) | 103.25 | 102.38 | 103.37 | 102.95 |
| Caliper Avg. SS, mm | .299 | .28 | .294 | .234 |
| Std. dev. | 0.14 | .031 | .007 | .006 |
| Apparent Density g/cc | .345 | .366 | .352 | .44 |
| Bulk, cc/g | 2.90 | 2.273 | 2.84 | 2.27 |
| Burst Average, Kpa | 190.44 | 253.00 | 275.32 | 349.05 |
| Std. dev. | 9.46 | 10.26 | 11.71 | 36.25 |
| Burst Index mN m(sq)/g | 1.84 | 2.47 | 2.66 | 3.39 |
| Tensile Avg. kg/m | 387.96 | 511.95 | 579.94 | 738.59 |
| Std. dev. | 28.83 | 15.20 | 10.54 | 58.38 |
| Breaking Length, Km | 3.76 | 5.00 | 5.61 | 7.17 |
| Tensile Index, kN*m/kg | 36.85 | 49.04 | 55.02 | 70.36 |
| Stretch Avg., % | 0.90 | 1.18 | 0.94 | 1.20 |
| Std. dev. | 0.00 | 0.11 | 0.09 | 0.14 |
| Tear Avg., 16 ply mN | 627.84 | 1067.33 | 774.34 | 549.36 |
| Std. dev. | 36.25 | 456.00 | 9.06 | 104.12 |
| Tear Index mH m(sq)/g | 6.08 | 10.42 | 7.49 | 5.34 |
| Double Folds Avg., 1.0 kg | NA | NA | NA | NA |
| Std. dev. | NA | NA | NA | NA |
| Gurley Air Resistance sec/100 cc 20 oz. cyl. | 16.6 | 30.67 | 57.23 | 1220.67 |
| Brightness, Elrepho | 21.17 | 20.87 | 21.80 | 21.13 |
| Concora Med. Test, N | 198.68 | 244.64 | 273.55 | 398.10 |
| Std. dev. | 20.02 | 5.63 | 9.09 | 7.92 |
| Ring Crush, kN/m | 1.40 | 1.41 | 1.80 | 1.83 |
| Std. dev. | 0.21 | 0.30 | 0.19 | 0.15 |

TABLE 3

100% Aspen

Cooking Time = 45 minutes
Cooking Sol. = 1 part MEA, 3 parts $NH_4OH$
Cooking Yield = 94.7%

| BEATING TIME, MINUTES | 35 | 40 | 48 | 63 |
|---|---|---|---|---|
| Freeness C.S., cc | 483 | 398 | 316 | 105 |
| O.D. Sheet Wt. | 2.56 | 2.66 | 2.64 | 2.65 |
| grams/meter (sq) | 127.96 | 133.23 | 132.06 | 132.35 |
| Caliper Avg. SS, mm | .304 | .291 | .259 | .247 |
| Std. dev. | .014 | .009 | .007 | .015 |
| Apparent Density g/cc | .421 | .458 | .51 | .536 |
| Bulk, cc/g | 2.38 | 2.18 | 1.96 | 1.87 |
| Burst Average, Kpa | 213.18 | 267.19 | 332.51 | 400.65 |
| Std. dev. | 11.92 | 9.98 | 30.40 | 19.05 |
| Burst Index mN m(sq)/g | 1.67 | 2.01 | 2.52 | 3.03 |
| Tensile Avg. kg/m | 409.29 | 482.62 | 644.10 | 875.91 |
| Std. dev. | 36.92 | 21.91 | 146.69 | 59.73 |
| Breaking Length, Km | 3.20 | 3.62 | 4.88 | 6.62 |
| Tensile Index, kN*m/kg | 31.37 | 35.52 | 47.83 | 64.90 |
| Stretch Avg., % | 0.96 | 1.02 | 1.08 | 1.12 |
| Std. dev. | 0.05 | 0.04 | 0.17 | 0.11 |
| Tear Avg., 16 ply mN | 740.85 | 706.32 | 815.41 | 651.38 |
| Std. dev. | 25.79 | 29.36 | 110.85 | 164.37 |
| Tear Index mH m(sq)/g | 5.79 | 5.30 | 6.17 | 4.92 |
| Double Folds Avg., 1.0 kg | NA | NA | NA | NA |
| Std. dev. | NA | NA | NA | NA |
| Gurley Air Resistance sec/100 cc 20 oz. cyl. | 17.90 | 29.50 | 73.43 | 669.70 |
| Brightness, Elrepho | 19.13 | 19.13 | 19.07 | 18.47 |
| Concora Med. Test, N | 229.07 | 264.66 | 318.7 | 446.28 |
| Std. dev. | 27.81 | 9.22 | 2.25 | 3.67 |
| Ring Crush, kN/m | 1.59 | 1.72 | 1.97 | 1.77 |
| Std. dev. | 0.13 | 0.08 | 0.10 | 0.05 |

TABLE 4

50% Aspen, 50% Oak

Cooking Time = 15 min.
Cooking Sol. - 1 part MEA, 3 parts $NH_4OH$
Cooking Yield = 85.46%

| BEATING TIME, MINUTES | 50 | 62 | 72 | 91 |
|---|---|---|---|---|
| Freeness C.S., cc | 504 | 408 | 308 | 117 |
| O.D. Sheet Wt. | 2.54 | 2.58 | 2.67 | 2.76 |

TABLE 4-continued

50% Aspen, 50% Oak

Cooking Time = 15 min.
Cooking Sol. - 1 part MEA, 3 parts $NH_4OH$
Cooking Yield = 85.46%

| BEATING TIME, MINUTES | 50 | 62 | 72 | 91 |
|---|---|---|---|---|
| grams/meter (sq) | 126.83 | 129.19 | 133.28 | 137.98 |
| Caliper Avg. SS, mm | .408 | .417 | .354 | .376 |
| Std. dev. | .024 | .021 | .013 | .007 |
| Apparent Density g/cc | .311 | .31 | .377 | .367 |
| Bulk, cc/g | 3.22 | 3.23 | 2.65 | 2.72 |
| Burst Average, Kpa | 102.52 | 117.75 | 169.49 | 197.74 |
| Std. dev. | 12.42 | 8.00 | 12.99 | 14.21 |
| Burst Index mN m(sq)/g | 0.81 | 0.91 | 1.27 | 1.43 |
| Tensile Avg. kg/m | 262.64 | 292.64 | 363.96 | 396.07 |
| Std. dev. | 15.88 | 16.40 | 42.51 | 59.56 |
| Breaking Length, Km | 2.07 | 2.27 | 2.73 | 2.87 |
| Tensile Index, kN*m/kg | 20.31 | 22.21 | 26.78 | 28.15 |
| Stretch Avg., % | 0.72 | 0.78 | 0.80 | 0.93 |
| Std. dev. | 0.04 | 0.13 | 0.10 | 0.05 |
| Tear Avg., 16 ply mN | 464.60 | 447.34 | 517.97 | 423.79 |
| Std. dev. | 26.26 | 11.10 | 66.59 | 22.53 |
| Tear Index mH m(sq)/g | 3.66 | 3.46 | 3.89 | 3.07 |
| Double Folds Avg., 1.0 kg | NA | NA | NA | NA |
| Std. dev. | NA | NA | NA | NA |
| Gurley Air Resistance sec/100 cc 20 oz. cyl. | 3.57 | 6.07 | 19.27 | 51.23 |
| Brightness, Elrepho | 19.10 | 18.77 | 18.90 | 20.07 |
| Concora Med. Test, N | 53.38 | 94.52 | 221.66 | 355.84 |
| Std. dev. | 8.90 | 37.98 | 4.71 | 5.35 |
| Ring Crush, kN/m | 0.90 | 1.11 | 1.50 | 1.81 |
| Std. dev. | 0.04 | 0.05 | 0.08 | 0.11 |

TABLE 5

50% Aspen, 50% Oak

Cooking Time = 30 min.
Cooking Sol. = 1 part MEA, 3 parts $NH_4OH$
Cooking Yield = 87.29%

| BEATING TIME, MINUTES | 50 | 60 | 68 | 90 |
|---|---|---|---|---|
| Freeness C.S., cc | 494 | .389 | 301 | 108 |
| O.D. Sheet Wt. | 2.50 | 2.78 | 2.71 | 2.65 |
| grams/meter (sq) | 124.89 | 138.93 | 135.50 | 132.56 |
| Caliper Avg. SS, mm | .385 | .42 | .369 | .321 |
| Std. dev. | .022 | .018 | .02 | .018 |
| Apparent Density g/cc | .324 | .331 | .367 | .413 |
| Bulk, cc/g | 3.09 | 3.02 | 2.72 | 2.42 |
| Burst Average, Kpa | 116.30 | 150.48 | 237.29 | 247.35 |
| Std. dev. | 9.79 | 6.76 | 10.44 | 14.27 |
| Burst Index mN m(sq)/g | 0.93 | 1.08 | 1.75 | 1.87 |
| Tensile Avg. kg/m | 267.97 | 344.63 | 483.95 | 523.95 |
| Std. dev. | 7.67 | 58.66 | 17.54 | 47.28 |
| Breaking Length, Km | 2.15 | 2.48 | 3.57 | 3.95 |
| Tensile Index, kN*m/kg | 21.04 | 24.33 | 35.03 | 38.76 |
| Stretch Avg., % | 0.74 | 0.92 | 1.06 | 1.06 |
| Std. dev. | 0.05 | 0.08 | 0.09 | 0.05 |
| Tear Avg., 16 ply mN | 530.52 | 740.85 | 684.35 | 483.44 |
| Std. dev. | 35.79 | 257.29 | 56.16 | 28.08 |
| Tear Index mH m(sq)/g | 4.25 | 5.33 | 5.05 | 3.65 |
| Double Folds Avg., 1.0 kg | NA | NA | NA | NA |
| Std. dev. | NA | NA | NA | NA |
| Gurley Air Resistance sec/100 cc 20 oz. cyl. | 4.00 | 6.77 | 18.13 | 80.70 |
| Brightness, Elrepho | 16.27 | 16.60 | 15.80 | 17.43 |
| Concora Med. Test, N | 100.82 | 163.69 | 286.90 | 362.51 |
| Std. dev. | 5.14 | 18.98 | 1.64 | 3.62 |
| Ring Crush, kN/m | 0.97 | 1.49 | 1.60 | 1.81 |
| Std. dev. | 0.04 | 0.23 | 0.17 | 0.11 |

As another example of a preferred embodiment of this invention, used to produce corrugating media pulp, fresh aspen chips were used. The chips were classified with a 1 inch screen and with a $\frac{1}{4}$ inch screen so that only material passing through the 1 inch screen and not passing through the $\frac{1}{4}$ inch screen was used. In order to optimize the composition of the pulping solution, initially, three laboratory cooks were used. The chips were initially presteamed for 10 minutes at 100 degrees C. The pulping solution was preheated to 160 degrees C. in a vertical digester, and the chips were then preheated to 142 degrees C. In the three cooks, a ratio of 4:1 liquor-to-wood was maintained although some water was added to the chips to prevent burning during the preheating process. In each cook, the chips were held for 15 minutes at 165 degrees C. and constant pressure.

After cooking, the chips were removed from the digester and fiberized hot in a refiner. Fiberized pulp was then washed with 150 degree F. water and dewatered using a press. At this point total yield was obtained.

Table 6 below sets forth the condition used in three separate tests of the process of this invention, and Tables 8–10 provide the physical data from said tests. Clearly the test utilizing equal quantities of monoethanolamine and ammonium hydroxide provided the optimum results. These laboratory tests were conducted in a McConnell horizontal rotary stainless steel digester. Refining was carried out with a Sprout Waldron Model 105 10 h.p. disc refiner equipped with spiked tooth plate Nos. 17780R and 17779S.

The pulping conditions were the same in all three laboratory cooks set forth in Table 1. The cooks were presteamed for 10 minutes at 100 degrees C. The NSCMP liquor was preheated to 160 degrees C. and the aspen chips were preheated to 142 degrees C. A 4:1 liquor to wood ratio was retained in these tests although some water was added to the chips to prevent burning during the preheating process. The cooks were held for 15 min. at 165 degrees C. after transferring the NSCMP liquor onto the chips.

After cooking the chips were removed from the digester and fiberized hot in the refiner. The fiberized pulp was then washed with 150 degree F. water and dewatered using a press. At this point the total yield was obtained by determining the oven dry weight of the pulp from a consistency determination and dividing the pulp weight by the oven dry weight of the initial charge.

TABLE 6

LABORATORY COOKING DATA

| Cook No. | 300 | 301 | 302 |
|---|---|---|---|
| Identification | NSCMP CTMP | NSCMP CTMP | NSCMP CTMP |
| Chip Type | ASPEN | ASPEN | ASPEN |
| Conditions | | | |
| Chip Solids, % | 53.54 | 53.63 | 54.35 |
| Chip Charge, O.D. Grams | 1500 | 1500 | 1500 |
| Pre-Steam Time, min. | 10 | 10 | 10 |
| Pre-Steam Temp, C. | 100 | 100 | 100 |
| Water from Steam, ML | 427 | 453 | 424 |
| "Prex" Time, min. | — | — | — |
| "Prex" Weight, tons | — | — | — |
| Liquor: Wood Ratio | 4:1 | 4:1 | 4:1 |
| Total Liquid, ML | 6000 | 6000 | 6000 |
| Liquor Pre-Heat Temp, C. | 160 | 160 | 160 |
| Liquor Pre-Heat Press, psi | 112 | 96 | 83 |
| Chip Pre-Heat Temp, C. | 142 | 142 | 142 |
| Chip Pre-Heat Pressure, psi | 54 | 50 | 46 |
| Initial Digester Temp w/Liquor Added, C. | 151 | 151 | 151 |
| Initial Digester Press w/Liquor Added, psi | 82 | 64 | 62 |
| Time Up, min. | 10 | 10 | 12 |
| Hold Time w/Liquor, min. | 15 | 15 | 15 |
| Cooking Temp, C. | 165 | 165 | 165 |
| Cooking Pressure, average psi | 113 | 103 | 94 |
| Vapor Phase Hold Time, min. | — | — | — |
| Vapor Phase Hold Temp, C. | — | — | — |
| Vapor Phase Hold Press, psi | — | — | — |

TABLE 6-continued

LABORATORY COOKING DATA

| Cook No. | 300 | 301 | 302 |
|---|---|---|---|
| Identification | NSCMP CTMP | NSCMP CTMP | NSCMP CTMP |
| Chip Type | ASPEN | ASPEN | ASPEN |
| Chemicals | | | |
| Chemical K-1, mls. (amine) | 125 | 125 | 125 |
| Chemical K-2, mls. (ammonium hyd.) | 375 | 125 | 62.5 |
| Water added, mls. | 3762 | 4000 | 4097 |
| Steam Conden. pH | 7.8 | 7.8 | 7.8 |
| Initial Liquor pH | 11.43 | 11.20 | 11.13 |
| Residual Liquor pH | 9.35 | 8.65 | 8.58 |
| Pulp Results | | | |
| Total Yield, % | 84.66 | 88.84 | 89.75 |

TABLE 7

PHYSICAL TEST DATA FOR COOK 300

| Beating Times, Min. | 12 | 25 | 32 |
|---|---|---|---|
| Freeness C.S., cc | 482 | 380 | 306 |
| O.D. Sheet Wt. | 2.57 | 2.52 | 2.55 |
| grams/meter (sq), oven dry | 128.63 | 126.13 | 127.47 |
| Caliper Avg. SS, mm | .232 | .213 | .203 |
| Standard Deviation | .006 | .005 | .004 |
| Apparent Density g/cc | .554 | .592 | .628 |
| Bulk, cc/g | 1.81 | 1.69 | 1.59 |
| Burst Average, Kpa | 253.55 | 361.79 | 400.24 |
| Standard Deviation | 14.96 | 16.05 | 20.30 |
| Coef. of Variation | 5.90 | 4.44 | 5.07 |
| Burst Index kPa*m(sq)/g | 1.97 | 2.87 | 3.14 |
| Tensile Avg. kN/m | 296.45 | 400.21 | 455.14 |
| Standard Deviation | 27.05 | 3.27 | 21.00 |
| Coef. of Variation | 9.12 | 0.82 | 4.61 |
| Breaking Length, Km | 3.52 | 4.85 | 5.46 |
| Tensile Index, kN*m/kg | 34.56 | 47.58 | 53.54 |
| Stretch Avg., % | 1.76 | 2.24 | 2.76 |
| Standard Deviation | 0.36 | 0.33 | 0.26 |
| Coef. of Variation | 20.33 | 14.67 | 9.45 |
| Tear Avg., 16 ply mN | 659.23 | 648.36 | 627.84 |
| Standard Deviation | 89.48 | 79.30 | 55.49 |
| Coef. of Variation | 13.57 | 12.23 | 8.84 |
| Tear Index mN*m(sq)/g | 5.13 | 5.14 | 4.93 |
| Gurley Air Resistance sec/100 cc 20 oz. cyl. | 33.45 | 108.40 | 248.95 |
| Brightness, Elrepho | 19.80 | 19.40 | 19.20 |
| Concora Med. Test, N | 231.30 | 299.80 | 350.06 |
| Standard Deviation | 8.65 | 4.30 | 2.21 |
| Coef. of Variation | 3.74 | 1.43 | 0.63 |
| Ring Crush, kN/m | 1.26 | 1.65 | 1.65 |
| Standard Deviation | 0.14 | 0.07 | 0.12 |
| Coef. of Variation | 10.85 | 4.43 | 7.19 |

TABLE 8

PHYSICAL TEST DATA FOR COOK 301

| Beating Times, Min. | 37 | 5 | 62 |
|---|---|---|---|
| Freeness C.S., cc | 507 | 418 | 303 |
| O.D. Sheet Wt. | 2.55 | 2.48 | 2.61 |
| grams/meter (sq), oven dry | 127.59 | 123.80 | 130.66 |
| Caliper Avg. SS, mn | .236 | .207 | .202 |
| Standard Deviation | .005 | .005 | .005 |
| Apparent Density g/cc | .541 | .598 | .647 |
| Bulk, cc/g | 1.85 | 1.67 | 1.55 |
| Burst Average, Kpa | 278.36 | 345.95 | 439.31 |
| Standard Deviation | 15.26 | 23.60 | 30.68 |
| Coef. of Variation | 5.48 | 6.82 | 6.98 |
| Burst Index kPa*m(sq)/g | 2.18 | 2.79 | 3.36 |
| Tensile Avg. kN/m | 345.28 | 413.29 | 490.89 |
| Standard Deviation | 16.71 | 3.27 | 22.53 |
| Coef. of Variation | 4.84 | 0.79 | 4.59 |
| Breaking Length, Km | 4.14 | 5.10 | 5.74 |
| Tensile Index, kN*m/kg | 40.58 | 50.06 | 56.33 |
| Stretch Avg., % | 1.82 | 2.26 | 2.94 |
| Standard Deviation | 0.22 | 0.23 | 0.17 |
| Coef. of Variation | 11.91 | 10.19 | 5.69 |
| Tear Avg., 16 ply mN | 871.13 | 761.26 | 855.43 |

TABLE 8-continued

| PHYSICAL TEST DATA FOR COOK 301 | | | |
|---|---|---|---|
| Beating Times, Min. | 37 | 5 | 62 |
| Standard Deviation | 42.99 | 21.49 | 32.83 |
| Coef. of Variation | 4.93 | 2.82 | 3.84 |
| Tear Index mN*m(sq)/g | 6.83 | 6.15 | 6.55 |
| Gurley Air Resistance sec/100 cc 20 oz. cyl. | 43.10 | 149.35 | 368.20 |
| Brightness, Elrepho | 20.80 | 20.60 | 20.30 |
| Concora Med. Test, N | 239.75 | 308.69 | 378.97 |
| Standard Deviation | 10.78 | 25.35 | 4.13 |
| Coef. of Variation | 4.50 | 8.21 | 1.09 |
| Ring Crush, kN/m | 1.41 | 1.68 | 1.69 |
| Standard Deviation | 0.19 | 0.12 | 0.11 |
| Coef. of Variation | 13.62 | 7.12 | 6.43 |

TABLE 9

| PHYSICAL TEST DATA FOR COOK 302 | | |
|---|---|---|
| Beating Times, Min. | 178 | 198 |
| Freeness C.S., cc | 407 | 307 |
| O.D. Sheet Wt. | 2.58 | 2.56 |
| grams/meter (sq), oven dry | 128.92 | 128.11 |
| Caliper Avg. SS, mm | .224 | .205 |
| Standard Deviation | .005 | .005 |
| Apparent Density g/cc | .576 | .625 |
| Bulk, cc/g | 1.74 | 1.60 |
| Burst Average, Kpa | 272.84 | 367.37 |
| Standard Deviation | 17.35 | 32.10 |
| Coef. of Variation | 6.36 | 8.74 |
| Burst Index kPa*m(sq)/g | 2.12 | 2.87 |
| Tensile Avg. kN/m | 367.51 | 455.55 |
| Standard Deviation | 16.28 | 22.74 |
| Coef. of Variation | 4.43 | 5.10 |
| Breaking Length, Km | 4.36 | 5.32 |
| Tensile Index, kN*m/kg | 42.74 | 52.15 |
| Stretch Avg., % | 2.16 | 2.36 |
| Standard Deviation | 0.17 | 0.22 |
| Coef. of Variation | 7.75 | 9.28 |
| Tear Avg., 16 ply mN | 722.02 | 690.62 |
| Standard Deviation | 102.33 | 65.66 |
| Coef. of Variation | 14.17 | 9.51 |
| Tear Index mN*m(sq)/g | 5.60 | 5.39 |
| Gurley Air Resistance | 57.70 | 241.10 |

TABLE 9-continued

| PHYSICAL TEST DATA FOR COOK 302 | | |
|---|---|---|
| Beating Times, Min. | 178 | 198 |
| sec/100 cc 20 oz. cyl. | | |
| Brightness, Elrepho | 21.80 | 21.40 |
| Concora Med. Test, N | 251.76 | 328.71 |
| Standard Deviation | 10.31 | 8.76 |
| Coef. of Variation | 4.10 | 2.66 |
| Ring Crush, kN/m | 1.53 | 1.68 |
| Standard Deviation | 0.10 | 0.14 |
| Coef. of Variation | 6.43 | 8.21 |

The pulping conditions were based on a constant temperature instead of pressure. It was found that excessive vapor pressure resulted with the NSCMP liquor. As the percentage of ammonium hydroxide increased, the vapor pressure increased; and the yield systematically dropped, indicative of a greater degree of pulping.

The conditions and chemical concentrations from cook 301 were chosen as superior due to the physical strengths and yield. The concorra, ring crush and percent stretch increase slightly in cook 301.

A marked trend or significant increase in physical strength was not evident when comparing the three cooks.

Further tests to optimize were conducted at pilot plant level using a Sunds defibrator which is a continuous digester. It was found that vapor equilibrium, however, was maintained more efficiently in a batch digester which therefore may be more chemically economical.

A total of six pulping trials were made to duplicate and optimize cooking conditions. The ratio of monoethanolamine to ammonia was varied from 1:1 to 1:3.5 to obtain best pulping kenetics. In addition several refiner plate clearances were tried.

The pulping and refining conditions are shown in Table 10 and the physical tests are shown in Tables 11–15.

TABLE 10

| CONDITIONS USED FOR THE PRODUCTION OF NSCMP CHEMITHERMOMECHANICAL PULP | | | | | | |
|---|---|---|---|---|---|---|
| Run No. 2299 | 1 | 2 | 3 | 4 | 4A | 5 |
| Chip Moisture, % | 47.64 | 47.64 | 47.64 | 47.64 | 47.64 | 47.64 |
| Infeed Hopper, Speed, r.p.m. | 13.0 | 13.5 | 13.5 | 15.0 | 15.0 | 15.0 |
| Presteaming Time, mins. | 10 | 10 | 10 | 10 | 10 | 10 |
| Preheater Pressure, psig | 90 | 90 | 90 | 95 | 98 | 98 |
| Temperature, degrees F. | 330 | 330 | 330 | 325 | 325 | 325 |
| Retention Time, mins. | 12.5 | 12.0 | 12.0 | 12.5 | 12.5 | 12.0 |
| Chip Level in Preheater, % Full | 90 | 80 | 80 | 80 | 80 | 80 |
| Refiner Pressure, psig | 90 | 90 | 90 | 95 | 98 | 98 |
| Plate Clearance, mm | 0.6 | 0.6 | 0.5 | 0.8 | 1.0 | 1.0 |
| Discharge Screw, r.p.m. | 10 | 10 | 10 | 10 | 10 | 10 |
| Refiner Dilution Water, l/min. | 0.6 | 0.6 | 0.6 | 0.4 | 0.4 | 0.4 |
| Chip Plug Pressure, psig | 45 | 45 | 45 | 45 | 45 | 45 |
| Discharge Consistency, % | 19.5 | 17.1 | — | 16.63 | — | — |
| Pulp Freeness, C.S., cc | — | 746 | 748 | — | 742 | 766 |
| Production Rate, OD Tons/Day | — | — | — | — | — | — |
| Power Used (net) Kwh/Ton | — | — | — | — | — | — |
| Yield, % | — | — | — | — | — | — |
| Liquor-to-Digester, l/min. | 1.70 | 1.70 | 2.20 | 2.16 | 2.16 | 2.16 |
| K-1:K-2 Ratio, as rec'd. | 1:1 | 1:1.37 | 1:1.35 | 1:1.35 | 1:1.35 | 1:1.35 |
| Liquor-to-Wood Ratio, Ca. | 4:1 | 4:1 | 4:1 | 4:1 | 4:1 | 4:1 |

Refiner Used
Defibrator Pilot Plant Unit 300 with 200 hp. motor (3565 r.p.m.)
Discs Employed
(a) Defibrator disc No. RW 3801 AGSE on Stator
(b) Defibrator disc No. RW 3809 AGSE on Rotor
Disc Diameter
12 inches

TABLE 11-A

CONDITIONS USED FOR THE PRODUCTION OF NSCMP CHEMITHERMOMECHANICAL PULP

| Run No. 2299 | 6* | Production | | | | |
|---|---|---|---|---|---|---|
| Chip Moisture, % | 48.13 | 48.13 | 48.13 | 48.13 | 48.13 | 48.13 |
| Infeed Hopper, Speed, r.p.m. | 16.0 | 16.0 | 16.0 | 16.0 | 16.0 | 16.0 |
| Presteaming Time, mins. | 10 | 10 | 10 | 10 | 10 | 10 |
| Preheater Pressure, psig | 100 | 108 | 102 | 102 | 104 | 100 |
| Temperature, degrees F. | 325 | 330 | 326 | 332 | 330 | 325 |
| Retention Time, mins. | 12.0 | 12.0 | 12.0 | 12.0 | 12.0 | 12.0 |
| Chip Level in Preheater, % Full | 80 | 80 | 80 | 80 | 80 | 80 |
| Refiner Pressure, psig | 100 | 108 | 102 | 102 | 104 | 100 |
| Plate Clearance, mm | 0.8 | 1.0 | 1.0 | 1.0 | 1.0 | 1.0 |
| Discharge Screw, r.p.m. | 10 | 10 | 10 | 10 | 10 | 10 |
| Refiner Dilution Water, l/min. | 0.4 | 0.4 | 0.4 | 0.4 | 0.4 | 0.4 |
| Chip Plug Pressure, psig | 47 | 47 | 47 | 47 | 47 | 47 |
| Discharge Consistency, % | 19.95 | 19.95 | 19.95 | 19.95 | 19.95 | 19.95 |
| Pulp Freeness, C.S., cc | 747 | 747 | 747 | 747 | 747 | 747 |
| Production Rate, OD Tons/Day | 1.06 | 1.06 | 1.06 | 1.06 | 1.06 | 1.06 |
| Power Used (net) Kwh/Ton | 90.9 | 90.9 | 90.9 | 90.9 | 90.9 | 90.9 |
| Yield, % | 91.59 | 91.59 | 91.59 | 91.59 | 91.59 | 91.59 |
| Liquor-to-Digester, l/min. | 2.33 | 2.33 | 2.30 | 2.30 | 2.12 | 2.12 |
| K-1:K-2 Ratio, as rec'd. | 1:1.35 | 1:1.35 | 1:1.35 | 1:1.35 | 1:1.35 | 1:1.35 |
| Liquor-to-Wood Ratio, Ca. | 4:1 | 4:1 | 4:1 | 4:1 | 4:1 | 4:1 |

*Run No. 6 includes all production runs.
Refiner Used
Defibrator Pilot Plant Unit 300 with 200 hp. motor (3565 r.p.m.)
Discs Employed
(a) Defibrator disc No. RW 3801 AGSE on Stator
(b) Defibrator disc No. RW 3809 AGSE on Rotor
Disc Diameter
12 inches

TABLE 11-B

CONDITIONS USED FOR THE PRODUCTION OF NSCMP CHEMITHERMOMECHANICAL PULP

| Run No. 2299 | Production | | | 7 | 8 |
|---|---|---|---|---|---|
| Chip Moisture, % | 48.13 | 48.13 | 48.13 | 48.13 | 48.13 |
| Infeed Hopper, Speed, r.p.m. | 16.0 | 16.0 | 16.0 | 16.0 | 16.0 |
| Presteaming Time, mins. | 10 | 10 | 10 | 10 | 10 |
| Preheater Pressure, psig | 110 | 108 | 100 | 102 | 102 |
| Temperature, degrees F. | 3285 | 332 | 3306 | 3302 | 330 |
| Retention Time, mins. | 12.0 | 12.0 | 12.0 | 24.0 | 24.0 |
| Chip Level in Preheater, % Full | 80 | 80 | 80 | 80 | 80 |
| Refiner Pressure, psig | 110 | 108 | 100 | 102 | — |
| Plate Clearance, mm | 1.0 | 1.0 | 1.0 | 1.0 | — |
| Discharge Screw, r.p.m. | 10 | 10 | 10 | 10 | — |
| Refiner Dilution Water, l/min. | 0.4 | 0.4 | 0.4 | 0.4 | — |
| Chip Plug Pressure, psig | 47 | 48 | 48 | 48 | 48 |
| Discharge Consistency, % | 19.95 | 19.95 | 19.95 | — | — |
| Pulp Freeness, C.S., cc | 747 | 747 | 747 | 745 | 773 |
| Production Rate, OD Tons/Day | 1.06 | 1.06 | 1.06 | — | — |
| Power Used (net) Kwh/Ton | 90.9 | 90.9 | 90.9 | — | — |
| Yield, % | 91.59 | 91.59 | 91.59 | — | — |
| Liquor-to-Digester, l/min. | 2.12 | 2.24 | 2.24 | 2.24 | 2.24 |
| K-1:K-2 Ratio, as rec'd. | 1:1.35 | 1:1.35 | 1:1.35 | 1:1.35 | 1:1.35 |
| Liquor-to-Wood Ratio, Ca. | 4:1 | 4:1 | 4:1 | 4:1 | 4:1 |

Refiner Used
Defibrator Pilot Plant Unit 300 with 200 hp. motor (3565 r.p.m.)
Discs Employed
(a) Defibrator disc No. RW 3801 AGSE on Stator
(b) Defibrator disc No. RW 3809 AGSE on Rotor
Disc Diameter
12 inches

TABLE 12

PHYSICAL TEST DATA FOR DEFIBRATOR COOK 2

| Beating Times, Min. | 74 | 92 | 105 |
|---|---|---|---|
| Freeness C.S., cc | 496 | 390 | 293 |
| O.D. Sheet Wt. | 2.55 | 2.58 | 2.55 |
| grams/meter (sq), oven dry | 127.41 | 129.11 | 127.41 |
| Caliper Avg. SS, mm | .266 | .26 | .213 |
| Standard Deviation | .005 | .004 | .005 |
| Apparent Density g/cc | .479 | .497 | .598 |
| Bulk, cc/g | 2.09 | 2.01 | 1.67 |
| Burst Average, Kpa | 110.79 | 155.30 | 216.55 |
| Standard Deviation | 9.73 | 5.89 | 14.20 |

TABLE 12-continued

PHYSICAL TEST DATA FOR DEFIBRATOR COOK 2

| Beating Times, Min. | 74 | 92 | 105 |
|---|---|---|---|
| Coef. of Variation | 8.79 | 3.79 | 6.56 |
| Burst Index kPa*m(sq)/g | 0.87 | 1.20 | 1.70 |
| Tensile Avg. kN/m | 196.18 | 247.62 | 307.79 |
| Standard Deviation | 9.75 | 20.31 | 15.90 |
| Coef. of Variation | 4.97 | 8.20 | 5.17 |
| Breaking Length, Km | 2.35 | 2.93 | 3.69 |
| Tensile Index, kN*m/kg | 23.09 | 28.76 | 36.22 |
| Stretch Avg., % | 1.28 | 1.44 | 1.60 |
| Standard Deviation | 0.11 | 0.30 | 0.20 |

TABLE 12-continued

| PHYSICAL TEST DATA FOR DEFIBRATOR COOK 2 | | | |
|---|---|---|---|
| Beating Times, Min. | 74 | 92 | 105 |
| Coef. of Variation | 8.56 | 20.60 | 12.50 |
| Tear Avg., 16 ply mN | 251.14 | 261.60 | 266.83 |
| Standard Deviation | 35.10 | 45.31 | 42.99 |
| Coef. of Variation | 13.98 | 17.32 | 16.11 |
| Tear Index mN*m(sq)/g | 1.97 | 2.03 | 2.09 |
| Gurley Air Resistance sec/100 cc 20 oz. cyl. | 12.27 | 28.27 | 91.60 |
| Brightness, Elrepho | 30.60 | 31.20 | 29.90 |
| Concora Med. Test, N | 157.01 | 221.96 | 283.78 |
| Standard Deviation | 7.28 | 9.01 | 2.70 |
| Coef. of Variation | 4.64 | 4.06 | 0.95 |
| Ring Crush, kN/m | 0.98 | 1.18 | 1.64 |
| Standard Deviation | 0.05 | 0.02 | 0.14 |
| Coef. of Variation | 5.10 | 2.09 | 8.70 |

TABLE 13

| PHYSICAL TEST DATA FOR DEFIBRATOR COOK 3 | | | |
|---|---|---|---|
| Beating Times, Min. | 73 | 90 | 100 |
| Freeness C.S., cc | 494 | 408 | 311 |
| O.D. Sheet Wt. | 2.52 | 2.60 | 2.57 |
| grams/meter(sq), oven dry | 125.99 | 130.03 | 128.32 |
| Caliper Avg. SS, mm | .255 | .243 | .202 |
| Standard Deviation | .007 | .005 | .002 |
| Apparent Density g/cc | .494 | .535 | .635 |
| Bulk, cc/g | 2.02 | 1.87 | 1.57 |
| Burst Average, Kpa | 118.03 | 185.69 | 230.75 |
| Standard Deviation | 9.03 | 6.04 | 10.66 |
| Coef. of Variation | 7.65 | 3.25 | 4.62 |
| Burst Index kPa*m(sq)/g | 0.94 | 1.43 | 1.80 |
| Tensile Avg. kN/m | 212.75 | 287.73 | 335.25 |
| Standard Deviation | 22.10 | 17.97 | 16.63 |
| Coef. of Variation | 10.39 | 6.25 | 4.96 |
| Breaking Length, Km | 2.58 | 3.38 | 3.99 |
| Tensile Index, kN*m/kg | 25.32 | 33.18 | 39.17 |
| Stretch Avg., % | 1.28 | 1.68 | 1.92 |
| Standard Deviation | 0.23 | 0.23 | 0.23 |
| Coef. of Variation | 17.82 | 13.57 | 11.88 |
| Tear Avg., 16 ply mN | 266.83 | 313.92 | 345.31 |
| Standard Deviation | 42.99 | 55.49 | 42.99 |
| Coef. of Variation | 16.11 | 17.68 | 12.45 |
| Tear Index mN*m(sq)/g | 2.12 | 2.41 | 2.69 |
| Gurley Air Resistance sec/100 cc 20 oz. cyl. | 12.43 | 40.97 | 137.30 |
| Brightness, Elrepho | 30.00 | 30.20 | 29.00 |
| Concora Med. Test, N | 159.68 | 254.87 | 310.47 |
| Standard Deviation | 6.10 | 9.39 | 1.40 |
| Coef. of Variation | 3.82 | 3.68 | 0.45 |
| Ring Crush, kN/m | 1.00 | 1.42 | 1.56 |
| Standard Deviation | 0.07 | 0.07 | 0.17 |
| Coef. of Variation | 6.60 | 5.17 | 10.63 |

TABLE 14

| PHYSICAL TEST DATA FOR DEFIBRATOR COOK 4A | | | |
|---|---|---|---|
| Beating Times, Min. | 52 | 65 | 76 |
| Freeness C.S., cc | 479 | 402 | 303 |
| O.D. Sheet Wt. | 2.52 | 2.51 | 2.56 |
| grams/meter (sq), oven dry | 126.19 | 125.56 | 127.81 |
| Caliper Avg. SS, mm. | .23 | .215 | .201 |
| Standard Deviation | .003 | .003 | .003 |
| Apparent Density g/cc | .549 | .584 | .636 |
| Bulk, cc/g | 1.82 | 1.71 | 1.57 |
| Burst Average, Kpa | 208.56 | 258.44 | 349.32 |
| Standard Deviation | 9.83 | 11.09 | 6.01 |
| Coef. of Variation | 4.71 | 4.29 | 1.72 |
| Burst Index kPa*m(sq)/g | 1.65 | 2.06 | 2.73 |
| Tensile Avg. kN/m | 266.81 | 314.32 | 384.08 |
| Standard Deviation | 25.68 | 3.27 | 32.42 |
| Coef. of Variation | 9.63 | 1.04 | 8.44 |
| Breaking Length, Km | 3.23 | 3.83 | 4.59 |
| Tensile Index, kN*m/kg | 31.70 | 37.54 | 45.06 |
| Stretch Avg., % | 1.92 | 2.16 | 2.56 |
| Standard Deviation | 0.30 | 0.46 | 0.33 |
| Coef. of Variation | 15.80 | 21.11 | 12.84 |
| Tear Avg., 16 ply mN | 517.97 | 549.36 | 565.06 |

TABLE 14-continued

| PHYSICAL TEST DATA FOR DEFIBRATOR COOK 4A | | | |
|---|---|---|---|
| Beating Times, Min. | 52 | 65 | 76 |
| Standard Deviation | 70.19 | 0.00 | 35.10 |
| Coef. of Variation | 13.55 | 0.00 | 6.21 |
| Tear Index mN*m(sq)/g | 4.10 | 4.38 | 4.42 |
| Gurley Air Resistance sec/100 cc 20 oz. cyl. | 17.47 | 48.97 | 158.63 |
| Brightness, Elrepho | 27.40 | 27.50 | 27.00 |
| Concora Med. Test, N | 243.75 | 292.01 | 346.28 |
| Standard Deviation | 14.94 | 17.73 | 5.42 |
| Coef. of Variation | 6.13 | 6.07 | 1.56 |
| Ring Crush, kN/m | 1.11 | 1.42 | 1.56 |
| Standard Deviation | 0.20 | 0.11 | 0.13 |
| Coef. of Variation | 17.90 | 7.70 | 8.61 |

TABLE 15

| PHYSICAL TEST DATA FOR DEFIBRATOR COOK 5 | | | |
|---|---|---|---|
| Beating Times, Min. | 59 | 74 | 87 |
| Freeness C.S., cc | 505 | 393 | 282 |
| O.D. Sheet Wt. | 2.53 | 2.55 | 2.54 |
| grams/meter (sq), oven dry | 126.74 | 127.46 | 126.92 |
| Caliper.Avg. SS, mm | .235 | .212 | .191 |
| Standard Deviation | .002 | .005 | .006 |
| Apparent Density g/cc | .539 | .601 | .665 |
| Bulk, cc/g | 1.86 | 1.66 | 1.50 |
| Burst Average, Kpa | 204.22 | 246.46 | 329.20 |
| Standard Deviation | 9.59 | 20.05 | 17.94 |
| Coef. of Variation | 4.70 | 8.14 | 5.45 |
| Burst Index kPa*m(sq)/g | 1.61 | 1.93 | 2.59 |
| Tensile Avg. kN/m | 269.42 | 325.22 | 379.72 |
| Standard Deviation | 17.61 | 3.27 | 10.04 |
| Coef. of Variation | 6.54 | 1.01 | 2.64 |
| Breaking Length, Km | 3.25 | 3.90 | 4.57 |
| Tensile Index, kN*m/kg | 31.88 | 38.26 | 44.86 |
| Stretch Avg., %. | 2.00 | 2.16 | 2.28 |
| Standard Deviation | 0.14 | 0.09 | 0.36 |
| Coef. of Variation | 7.07 | 4.14 | 15.94 |
| Tear Avg., 16 ply mN | 502.27 | 565.06 | 568.98 |
| Standard Deviation | 70.19 | 65.66 | 39.24 |
| Coef. of Variation | 13.98 | 11.62 | 6.90 |
| Tear Index mN*m(sq)/g | 3.96 | 4.43 | 4.48 |
| Gurley Air Resistance sec/100 cc 20 oz. cyl. | 18.63 | 44.73 | 273.43 |
| Brightness, Elrepho | 29.80 | 28.90 | 28.60 |
| Concora Med. Test, N | 218.84 | 269.10 | 344.28 |
| Standard Deviation | 7.79 | 9.44 | 2.76 |
| Coef. of Variation | 3.56 | 3.51 | 0.80 |
| Ring Crush, kN/m | 1.02 | 1.20 | 1.51 |
| Standard Deviation | 0.11 | 0.12 | 0.10 |
| Coef. of Variation | 10.33 | 10.35 | 6.45 |

TABLE 16

| PHYSICAL TEST DATA FOR PRODUCTION SAMPLE DRUM NO. 1 DIFIBRATOR | | | |
|---|---|---|---|
| Beating Times, Min. | 45 | 57 | 64 |
| Freeness C.S., cc | 492 | 391 | 302 |
| O.D. Sheet Wt. | 2.58 | 2.56 | 2.57 |
| grams/meter (sq), oven dry | 128.93 | 127.85 | 128.57 |
| Caliper Avg. SS, mm | .206 | .193 | .18 |
| Standard Deviation | .003 | .004 | .006 |
| Apparent Density g/cc | .626 | .662 | .714 |
| Bulk, cc/g | 1.60 | 1.51 | 1.40 |
| Burst Average, Kpa | 248.25 | 300.13 | 362.14 |
| Standard Deviation | 20.42 | 16.06 | 21.98 |
| Coef. of Variation | 8.22 | 5.35 | 6.07 |
| Burst Index kPa*m(sq)/g | 1.93 | 2.35 | 2.82 |
| Tensile Avg. kN/m | 304.30 | 350.51 | 400.21 |
| Standard Deviation | 32.83 | 3.27 | 21.93 |
| Coef. of Variation | 10.79 | 0.93 | 5.48 |
| Breaking Length, Km | 3.61 | 4.19 | 4.76 |
| Tensile Index, kN*m/kg | 35.39 | 41.11 | 46.67 |
| Stretch Avg., % | 1.92 | 2.24 | 2.64 |
| Standard Deviation | 0.46 | 0.26 | 0.38 |
| Coef. of Variation | 23.98 | 11.64 | 14.57 |
| Tear Avg., 16 ply mN | 580.75 | 565.06 | 580.75 |
| Standard Deviation | 42.99 | 35.10 | 42.99 |

TABLE 16-continued

PHYSICAL TEST DATA FOR PRODUCTION SAMPLE DRUM NO. 1 DIFIBRATOR

| Beating Times, Min. | 45 | 57 | 64 |
|---|---|---|---|
| Coef. of Variation | 7.40 | 6.21 | 7.40 |
| Tear Index mN*m(sq)/g | 4.50 | 4.42 | 4.52 |
| Gurley Air Resistance sec/100 cc 20 oz. cyl. | 51.83 | 121.93 | 310.10 |
| Brightness, Elrepho | 26.60 | 26.40 | 26.10 |
| Concora Med. Test, N | 295.79 | 323.81 | 350.50 |
| Standard Deviation | 11.00 | 11.73 | 3.58 |
| Coef. of Variation | 3.72 | 3.62 | 1.02 |
| Ring Crush, kN/m | 1.36 | 1.40 | 1.47 |
| Standard Deviation | 0.19 | 0.16 | 0.13 |
| Coef. of Variation | 14.33 | 11.12 | 8.58 |

Run Nos. 2299-7 and 2299-8 were made to determine if the Sunds refiner plates were ideally suited to preserve tear and if extending pulping time would increase the physical paper properties significantly.

The retention time was increased from 12 to 24 minutes in both cooks. Run No. 2299-7 was treated identically to the production run with the exception of retention time. Run No. 2299-8 was held 24 minutes in the digester and then the chips were removed and defibered in the Sprout Walden refiner. Secondary refining was performed on both samples in a valley beater to ensure identical treatment. The physical test data are shown in Tables 17 and 18. As shown, the physical properties are improved when different refining conditions are used.

The pulp was then fed to a Sprout Waldron 36-2 disc refiner powered by a 4-speed, 300 hp motor operated at 1800 r.p.m., wherein deshiving occurred. Deshiving data are shown in Table 19.

Deshived pulp was then washed by processing over the wet end of a 36" Fourdrinier paper machine. Washed pulp was refined in a 3-pass operation at a consistency of 3.1% to a C.S. (Canadian Standard) freeness of 365. Refining was accomplished by pulping from one chest through the refiner into another chest. Refining data are shown at Table 20.

Waste clippings were dispersed in a hydrapulper and passed through a twin flow refiner at a wide plate clearance to disperse any fiber bundles. Freeness before the twin flow was 541 C.S.F. and after the twin flow was 435 C.S.F.

Two papers were produced. One paper consisted of 85% NSCMP aspen and 15% clippings and the other was 100% NSCMP aspen. Both papers ran well and a large role was produced from each. Each furnish was pumped from the machine chest through a Foxboro Flow Controller to the suction of a fan pump. Thick stock was diluted with white water from the wire to the required paper making consistency at the fan pump. The fiber slurry was pumped from the fan pump through a 5-pipe manifold inlet to the head box. Paper produced was wound on 3-inch fiber cores.

The paper making test data are shown on Table 21. Dry end paper test data are shown on Table 22.

TABLE 17

PHYSICAL TEST DATA FOR PULP SAMPLE PASSING THROUGH REFINER (DIGESTER HOLD TIME: 24 MIN.)

| Beating Times, Min. | 41 | 51 | 60 |
|---|---|---|---|
| Freeness C.S., cc | 494 | 389 | 315 |
| O.D. Sheet Wt. | 2.55 | 2.57 | 2.54 |
| grams/meter (sq), oven dry | 127.63 | 128.27 | 126.90 |
| Caliper Avg. SS, mm | .224 | .216 | .199 |
| Standard Deviation | .005 | .006 | .004 |

TABLE 17-continued

PHYSICAL TEST DATA FOR PULP SAMPLE PASSING THROUGH REFINER (DIGESTER HOLD TIME: 24 MIN.)

| Beating Times, Min. | 41 | 51 | 60 |
|---|---|---|---|
| Apparent Density g/cc | .57 | .594 | .638 |
| Bulk, cc/g | 1.75 | 1.68 | 1.57 |
| Burst Average, Kpa | 236.05 | 281.53 | 356.76 |
| Standard Deviation | 15.23 | 10.68 | 11.30 |
| Coef. of Variation | 6.45 | 3.79 | 3.17 |
| Burst Index kPa*m(sq)/g | 1.85 | 2.19 | 2.81 |
| Tensile Avg. kN/m | 5.17 | 5.36 | 6.33 |
| Standard Deviation | 0.18 | 0.18 | 0.53 |
| Coef. of Variation | 3.58 | 3.36 | 8.37 |
| Breaking Length, Km | 4.13 | 4.26 | 5.08 |
| Tensile Index, kN*m/kg | 40.46 | 41.79 | 49.84 |
| Stretch Avg., % | 2.20 | 1.80 | 3.15 |
| Standard Deviation | 0.14 | 0.28 | 0.21 |
| Coef. of Variation | 6.43 | 15.71 | 6.73 |
| Tear Avg., 16 ply mN | 674.93 | 627.84 | 612.14 |
| Standard Deviation | 32.83 | 27.75 | 35.10 |
| Coef. of Variation | 4.86 | 4.42 | 5.73 |
| Tear Index mN*m(sq)/g | 5.29 | 4.89 | 4.82 |
| Gurley Air Resistance sec/100 cc 20 oz. cyl. | 21.40 | 46.93 | 137.33 |
| Brightness, Elrepho | 24.80 | 24.73 | 24.63 |
| Concora Med. Test, N | 264.21 | 310.47 | 370.52 |
| Standard Deviation | 11.13 | 11.25 | 3.62 |
| Coef. of Variation | 4.21 | 3.62 | 0.98 |
| Ring Crush, kN/m | 1.39 | 1.45 | 1.61 |
| Standard Deviation | 0.13 | 0.11 | 0.07 |
| Coef. of Variation | 9.11 | 7.62 | 4.23 |

TABLE 18

PHYSICAL TEST DATA FOR CHIPS REMOVED FROM THE DIGESTER AND DEFIBERED IN A LABORATORY REFINER (12" DISC) (DIGESTER HOLD TIME: 25 MIN.)

| Beating Times, Min. | 36 | 47 | 62 |
|---|---|---|---|
| Freeness C.S., cc | 502 | 404 | 305 |
| O.D. Sheet Wt. | 2.56 | 2.56 | 2.57 |
| grams/meter (sq), oven dry | 127.89 | 127.80 | 128.43 |
| Caliper Avg. SS, mm | .23 | .227 | .2 |
| Standard Deviation | .003 | .006 | .003 |
| Apparent Density g/cc | .556 | .563 | .642 |
| Bulk, cc/g | 1.80 | 1.78 | 1.56 |
| Burst Average, Kpa | 233.09 | 280.97 | 381.02 |
| Standard Deviation | 22.22 | 11.42 | 18.93 |
| Coef. of Variation | 9.53 | 4.06 | 4.97 |
| Burst Index kPa*m(sq)/g | 1.82 | 2.20 | 2.97 |
| Tensile Avg. kN/m | 5.02 | 5.92 | 7.36 |
| Standard Deviation | 0.39 | 0.14 | 0.09 |
| Coef. of Variation | 7.77 | 2.36 | 1.22 |
| Breaking Length, Kmw | 4.00 | 4.72 | 5.84 |
| Tensile Index, kN*m/kg | 39.23 | 46.29 | 57.26 |
| Stretch Avg., % | 1.85 | 2.10 | 2.55 |
| Standard Deviation | 0.35 | 0.14 | 0.21 |
| Coef. of Variation | 19.11 | 6.73 | 8.32 |
| Tear Avg., 16 ply mN | 753.41 | 729.86 | 706.32 |
| Standard Deviation | 32.83 | 35.10 | 27.75 |
| Coef. of Variation | 4.36 | 4.81 | 3.93 |
| Tear Index mN*m(sq)/g | 5.89 | 5.71 | 5.50 |
| Gurley Air Resistance sec/100 cc 20 oz. cyl. | 31.07 | 66.40 | 176.90 |
| Brightness, Elrepho | 26.17 | 26.73 | 25.97 |
| Concora Med. Test, N | 237.97 | 283.78 | 335.38 |
| Standard Deviation | 8.45 | 10.85 | 2.01 |
| Coef. of Variation | 3.55 | 3.83 | 0.60 |
| Ring Crush, kN/m | 1.34 | 1.53 | 1.62 |
| Standard Deviation | 0.13 | 0.08 | 0.08 |
| Coef. of Variation | 9.67 | 5.18 | 4.81 |

TABLE 19

DESHIVING DATA, 36-2 DISC REFINER

| Run No. 2299-1 | |
|---|---|
| Plate Pattern, Rotor | D14A002 |
| Stator | D14A002 |

TABLE 19-continued

| DESHIVING DATA, 36-2 DISC REFINER | |
|---|---|
| Run No. 2299-1 | |
| Ring Pattern | 17709° |
| Refiner Speed, r.p.m. | 1800 |
| Type Feed | Belt Conveyor |
| Type Pulp | NSCMP Aspen |
| Refining Consistency, % | 25 |
| OD Tons/Day Production | 6.12 |
| HP Days/OD Ton, Gross | 11.4 |
| Net | 5.8 |
| Freeness to Refiner, 3 g., C.S. | 750 |
| from Refiner, 3 g., C.S. | 654 |
| Plate Clearance, Mils | +8 |
| Ring Clearance, Mils | Off |

TABLE 20

| 12" TWIN FLOW REFINER DATA | | | |
|---|---|---|---|
| Pass No. | 1 | 2 | 3 |
| Plate Patter, Stator Motor End | | D5A007 | |
| Rotor Motor End | | D5A007 | |
| Rotor Cylinder End | | D5A008 | |
| Stator Cylinder End | | D5A008 | |
| Refiner Speed, r.p.m. | | 1800 | |
| Total Amperage | 90 | 90 | 80 |
| Idle Amperage | 70 | 70 | 70 |
| Refining Amperage | 20 | 20 | 10 |
| Refining Consistency, % | 3.10 | 3.10 | 3.10 |
| Flow Rate, g.p.m. | 120 | 120 | 140 |
| OD Tons/Day Production | 22.3 | 22.3 | 26.1 |
| HP Days/OD Ton, Gross | 3.6 | 3.6 | 2.7 |
| Net | 0.79 | 0.79 | 0.34 |
| Freeness to Refiner, 3 g, C.S. | 636 | 536 | 426 |
| from Refiner, 3 g., C.S. | 536 | 426 | 365 |

TABLE 21

| PAPER MACHINE DATA | | |
|---|---|---|
| Run Number | 2299-1 | 2299-2 |
| Furnish, % | | |
| NSCMP Aspen | 85 | 100 |
| Clippings | 15 | — |
| Chest Freeness, C.S., ml. | 410 | 386 |
| Consistency, % | 2.29 | 2.63 |
| pH | 8.2 | 8.3 |
| Headbox Freeness, C.S., ml. | 356 | 369 |
| Consistency, % | 0.63 | 0.60 |
| pH | 8.1 | 8.1 |
| Homogenizing Roll, r.p.m. | 150 | 150 |
| Top | | |
| Shake, Strokes per Minute | 190 | 190 |
| Machine Speed, f.p.m. | 70 | 70 |
| Vacuum in Hg., 1st Box | 4.0 | 4.0 |
| 2nd Box | 4.5 | 4.5 |
| 3rd Box | 4.5 | 4.5 |
| 4th Box | 4.0 | 4.0 |
| Couch | 7.0 | 6.0 |
| Pressing PLI, 1st Press | 180 | 180 |
| 2nd Press | 160 | 160 |
| Pressing PLI, Calender, 1 Nip | 50 | 50 |
| Drier Pressure, psig | | |
| 1st Section, Drier #1 | 30 | 20 |
| #2 | 30 | 20 |
| #3 & #4 | 30 | 20 |
| #5, #6, & #7 | 30 | 20 |
| 2nd Section, Drier # | | |
| #8, #10, & #12 | 30 | 20 |
| #9 & #11 | 30 | 20 |
| Target, g/m$^2$ | 118 | 118 |
| Date of Run, July 1983 | 29 | 29 |

TABLE 22

| DRY END PAPER TEST DATA | | | | | | | |
|---|---|---|---|---|---|---|---|
| Run No. | Basis Wt. gm/$^2$ | | Caliper - Mils | | | Moisture Content | |
| 2299 | Front | Back | Front | Middle | Back | % O.D. | % Moisture |
| Start 1 | 119.8 | 119.8 | 8.6 | 8.7 | 8.8 | 95.0 | 5.0 |
| End | 123.0 | 123.0 | 8.9 | 8.9 | 8.9 | 94.4 | 5.6 |
| Start 2 | 117.5 | 117.5 | 8.4 | 8.5 | 8.2 | 94.9 | 5.1 |
| End | 118.5 | 118.5 | 8.3 | 8.5 | 8.4 | 94.0 | 6.0 |

TABLE 23

| PHYSICAL TEST DATA FOR SAMPLES FROM RUN 1 AND 2 | | | | |
|---|---|---|---|---|
| Sample ID | Run 1 MD | Run 1 CD | Run 2 MD | Run 2 CD |
| grams/meter (sq.), conditioned basis | 132.00 | | 128.30 | |
| grams/meter (sq.), Oven dry | 121.50 | | 117.82 | |
| Caliper Avg. SS, mm. | .225 | | .214 | |
| Std. dev. | .004 | | .007 | |
| Apparent Density g/cc | .587 | | .6 | |
| Bulk, cc/g | 1.70 | | 1.67 | |
| Burst Average, kPa | 232.81 | | 193.13 | |
| Standard Deviation | 11.94 | | 27.79 | |
| Coef. of Variation | 5.13 | | 14.39 | |
| Burst Index mN*m(sq.)/g | 1.76 | | 1.51 | |
| Tensile Avg. kN/m | 6.45 | 3.95 | 6.02 | 2.81 |
| Standard Deviation | 0.57 | 0.10 | 0.41 | 0.04 |
| Coef. of Variation | 8.87 | 2.44 | 6.89. | 1.36 |
| Breaking Length, Km | 4.99 | 3.05 | 4.79 | 2.23 |
| Tensile Index, kN*m/kg | 48.88 | 29.91 | 46.96 | 21.89 |
| Tensile MD/CO Ratio | 1.63 | | 2.15 | |
| Stretch Avg., % | 1.66 | 2.69 | 1.34 | 2.43 |
| Standard Deviation | 0.11 | 0.18 | 0.13 | 0.15 |
| Coef. of Variation | 6.67 | 6.69 | 9.89 | 6.26 |
| Tear Avg., 16 ply mN | 903.15 | 1017.10 | 432.58 | 725.16 |
| Standard Deviation | 91.16 | 128.19 | 77.45 | 23.28 |
| Coef. of Variation | 10.09 | 12.60 | 17.90 | 3.21 |
| Tear Index mN*m(sq.)/g | 6.84 | 7.71 | 3.37 | 5.65 |
| Wet Web Breaking Length, m | 44.90 | | 23.00 | |
| Wet Web Stretch, % | 3.4 | | 2.22 | |
| Gurley Air Resistance sec/100 cc 20 oz. cyl. | 8.77 | | 9.37 | |
| Brightness, Elrepho | 21.10 | | 21.83 | |
| Concora Med. Test, N | 255.76 | | 269.10 | |
| Standard Deviation | 24.29 | | 6.26 | |
| Coef. of Variation | 9.5 | | 2.33 | |
| Ring Crush, kN/m | | 1.22 | | 1.02 |
| Standard Deviation | | .07 | | .15 |
| Coef. of Variation | | 6.00 | | 14.75 |

In summary, it has been discovered that superior container media pulp can be produced from hardwood according to the process of this invention on a continuous basis wherein the pulping liquor is a dilute aqueous solution of a lower alkanolamine and ammonium hydroxide wherein the weight ratio is one part amine to about one to about three parts ammonium hydroxide. In one preferred embodiment substantially equal concentrations of the amine and ammonium hydroxide are present. In another preferred embodiment a ratio of 1:3 was preferred. Successful tests have been conducted at other ratios. While the strength characteristics remain roughly equivalent between pulps produced with higher concentrations of ammonia, in a continuous process superior pulps are produced when the concentration of ammonia remains about equal to that of the amine. In the preferred embodiments the weight ratio of liquor to chips is maintained at about 4:1. While the ratio of amine to chips remains unchanged, in a continuous operation a greater yield is achieved by lowering the concentration of ammonia.

The invention may be embodied in other specific forms without departing from the spirit or essential characteristics thereof. The present embodiment is, therefore, to be considered in all respects as illustrative and not restrictive, the scope of the invention being indicated by the appended claims and all changes which come within the meaning and range of equivalency of the claims are, therefore, intended to be embraced therein.

What is claimed is:

1. A process for pulping woody materials comprising:

providing a pulping solution containing a dilute mixture of a lower alkanolamine and ammonium hydroxide in water;

providing a heated vessel;

admitting a predetermined quantity of chips and solution to said vessel;

impregnating said chips in said solution and digesting said chips under conditions of temperature and pressure effective to initiate a lignin depolymerization reaction in said chips for a predetermined period of time;

refining said chips to produce said pulp and separating the used solution from the pulp.

2. The process of claim 1 wherein said lower alkanolamine is monoethanolamine.

3. The process of claim 2 wherein said monoethanolamine is present in a ratio to ammonium hydroxide of 1 part to about 3, by weight.

4. The process of claim 3 wherein the step of digesting further comprises lowering the level of solution in said vessel below the chips;

vaporizing said solution, in part, and circulating said solution vapor above, below and on all sides of said chips to digest said chips under a vapor dome.

5. The process of claim 1 wherein said chips are hardwood chips and said pulp produced is corrugating medium pulp produced in a yield of about 85–95%.

6. The process of claim 1 wherein said lignin depolymerization reaction is maintained under a temperature of about 285° F. and a pressure of at least about 50 psi for at least about 15 minutes.

7. A process for producing corrugating medium pulp from hardwood chips comprising:

providing a pulping solution containing a dilute aqueous mixture of a lower alkanolamine and ammonium hydroxide;

providing a heated vessel;

admitting a predetermined quantity of said chips to said vessel;

heating said solution;

subsequently digesting said chips in said vessel under conditions of temperature and pressure effective to initiate a lignin depolymerization reaction in said chips for a predetermined period of time;

refining said chips to produce said pulp; and separating the used solution from the pulp for chemical reactant recovery.

8. The process of claim 7 wherein said lower alkanolamine is monoethanolamine.

9. The process of claim 8 wherein said monoethanolamine is present in a ratio to ammonium hydroxide of 1 to about 3 parts by weight.

10. The process of claim 9 wherein said pulping solution comprises about 10–12 gallons monoethanolamine to 36–40 gallons ammonium hydroxide to about 1,000 gallons water.

11. The process of claim 10 wherein said solution and chips are present in a ratio of about 600 gallons to 2,000–3,000 pounds chips.

12. The process of claim 11 wherein the step of digestion further comprises lowering the level of solution in said vessel below the chips;

vaporizing said solution at least in part; and circulating said solution vapor above, below and on all sides of said chips to digest said chips under a vapor dome.

13. A continuous process for producing corrugating medium pulp from hardwood chips comprising:

providing a pulping solution of a dilute aqueous mixture of 1 part of a lower alkanolamine and less than 3 parts ammonium hydroxide;

providing a heated vessel;

admitting a predetermined quantity of chips to said vessel;

heating said solution;

subsequently digesting said chips in said vessel under conditions of temperature and pressure effective to initiate alignin depolymerization reaction in said chips for a predetermined period of time;

refining said chips to produce said pulp; and separating the used solution from the pulp for chemical reactant recovery.

14. The process of claim 13, wherein the lower alkanolamine is monoethanolamine.

15. The process of claim 13, wherein said ammonium hydroxide is present in a weight ratio to the lower alkanolamine of about at least 1:1.

16. The process of claim 13, wherein the step of digesting said chips further comprises maintaining a weight ratio of about 4:1 of said pulping solution to said chips during said digestion step.

17. The method of claim 13 wherein said chips are maintained in said digestion vessel for a predetermined period of time of about 15 minutes.

* * * * *